US008955701B2

(12) United States Patent
Ueda et al.

(10) Patent No.: US 8,955,701 B2
(45) Date of Patent: Feb. 17, 2015

(54) METHOD OF SWING STOPPING CONTROL AND SYSTEM OF SWING STOPPING CONTROL OF SUSPENDED LOAD OF CRANE

(75) Inventors: Hideto Ueda, Hachioji (JP); Takayuki Kaneko, Kodaira (JP); Hisashi Yoshizaki, Tokyo (JP)

(73) Assignee: Fuji Electric Co., Ltd., Kawasaki (JP)

( * ) Notice: Subject to any disclaimer, the term of this patent is extended or adjusted under 35 U.S.C. 154(b) by 360 days.

(21) Appl. No.: 13/416,393

(22) Filed: Mar. 9, 2012

(65) Prior Publication Data

US 2012/0234787 A1 Sep. 20, 2012

(30) Foreign Application Priority Data

Mar. 17, 2011 (JP) ..... 2011-058751

(51) Int. Cl.
*B66C 13/06* (2006.01)

(52) U.S. Cl.
CPC ..... *B66C 13/06* (2013.01)
USPC ..... 212/275; 212/276; 212/83; 212/97

(58) Field of Classification Search
CPC ..... B66C 13/06; B66C 13/063
USPC ..... 212/272, 273, 275, 276, 83, 97
See application file for complete search history.

(56) References Cited

U.S. PATENT DOCUMENTS

| | | | | |
|---|---|---|---|---|
| 4,997,095 | A * | 3/1991 | Jones et al. | 212/275 |
| 6,102,221 | A * | 8/2000 | Habisohn | 212/270 |
| 2010/0012611 | A1 * | 1/2010 | Sawodny et al. | 212/273 |

FOREIGN PATENT DOCUMENTS

| | | |
|---|---|---|
| JP | 7-257876 | 10/1995 |
| JP | 3019661 | 1/2000 |

* cited by examiner

*Primary Examiner* — Emmanuel M Marcelo
*Assistant Examiner* — Angela Caligiuri

(57) ABSTRACT

A method of swing stopping control of a suspended load of a crane including a hoist and a trolley solves an equation of motion, given as an equation with respect to the deviation angle of a suspended load from the vertical direction when the trolley travels, for the trolley acceleration to thereby obtain the value of the acceleration or deceleration of the trolley, obtains speed patterns corresponding to the values of the acceleration or deceleration, drives the trolley according to the obtained speed patterns, and carries out control so that the deviation angle of the suspended load from the vertical direction becomes zero at the time when the acceleration or deceleration of the trolley is ended. Thus, even if the length of a rope holding the suspended load up is changed, a required speed pattern is produced to permit highly accurate positioning.

6 Claims, 7 Drawing Sheets

METHOD OF SWING STOPPING CONTROL AND SYSTEM OF SWING STOPPING CONTROL OF SUSPENDED LOAD OF CRANE

CROSS-REFERENCE TO RELATED APPLICATIONS

This application claims the benefit of Japanese Application No. 2011-058751, filed Mar. 17, 2011, in the Japanese Intellectual Property Office, the disclosure of which is incorporated herein by reference.

BACKGROUND

1. Field

Embodiments of the present invention relate to a method of swing stopping control and a system of swing stopping control for carrying out swing stopping of a suspended load of a suspension type crane when carrying the suspended load to a target position by a trolley in the suspension type crane that is used for loading and unloading work at sites such as harbors, iron works and various kinds of factories.

2. Description of the Related Art

In loading and unloading work carried out by using a suspension type crane, from the view point of improving the efficiency of the loading and unloading work by reducing cycle time, not only positioning control that makes a suspended load correctly reach a target position in a short time but also swing stopping control is generally required that makes a deviation angle of the rope of the suspended load from the vertical direction reduced to zero when the suspended load is carried to the target position. For actualizing such swing stopping control, various kinds of control methods have been previously proposed.

In Japanese Patent No. 3,019,661 (paragraphs [0011] to [0015] and FIG. 3, FIG. 5, FIG. 7, etc.), for example, a crane operation control method is described in which the acceleration of a trolley is continuously changed to smoothly change the trolley speed. In the method, an acceleration pattern is set into a positive and negative triangle-like or trapezoid-like form with a constant speed section in between, by which a slip caused between a trolley wheel and a rail due to a rapid change in a trolley speed is prevented to make positioning accuracy and swing stopping accuracy of a trolley improved.

Moreover, in JP-A-7-257876 (paragraphs [0009] to [0013] and FIG. 5, etc.), a swing stopping control method is disclosed which is applied in the case in which the length of a rope holding a suspended load up is changed as in the case of carrying out lifting or lowering of the suspended load and traversing a trolley at the same time. Namely, the control method is a method in which the swinging period of a suspended load is obtained on the basis of an equation of motion with respect to a deviation angle of the rope of the suspended load from the vertical direction by using representative values of attenuation coefficients and natural frequencies that vary depending on the length of the rope, and then compensate the acceleration of the trolley at the time being halfway through the swinging period (such as the time at one-half of the period) to thereby produce such a speed pattern as to reduce a residual swing.

In the related art according to Japanese Patent No. 3,019,661, an acceleration pattern of the trolley is formed on the basis of the swinging period of a suspended load obtained with respect to a fixed rope length without assuming the case in which the rope length changes on the way of the traversing of the trolley. Thus, in the case in which a rope length changes, the related art can not be directly applied to the case.

In the related art according to JP-A-7-257876, there was a problem in that such a speed pattern that the speed of a trolley changes in the course of acceleration or deceleration of the trolley is formed to thereby require complicated acceleration correction operations.

Moreover, in the case of generally carrying out swing stopping control with a suspended load likened to a simple pendulum, a reference swinging period that is set beforehand causes the swinging condition of the suspended load to be changed, by which it is difficult to set the swinging period to the optimum value.

Accordingly, it is an object of embodiments of the invention to provide a method of swing stopping control and a system of swing stopping control in each of which a required speed pattern is produced by relatively simple arithmetic operations to permit highly accurate swing stopping of a suspended load even in the case in which the length of a rope holding a suspended load up is changed.

Moreover, it is another object of embodiments of the invention to make it possible to carry out highly accurate positioning of a trolley by carrying out an operation with respect to an adequate deceleration initiation distance of the trolley and initiating the deceleration of the trolley at the time when the positional deviation of the travel of the trolley to the target position of the trolley becomes equal to the deceleration initiation distance obtained from the operation.

SUMMARY

Additional aspects and/or advantages will be set forth in part in the description which follows and, in part, will be apparent from the description, or may be learned by practice of the invention.

For achieving the objects, the method of swing stopping control of a suspended load according to embodiments of the invention is a method of obtaining speed patterns at the time of acceleration or deceleration of a trolley on the basis of an equation of motion with respect to the deviation angle of a suspended load (rope) from the vertical direction when the trolley travels, and driving the trolley according to the obtained speed patterns. For further details, the method, by solving the equation of motion for trolley acceleration, obtains the acceleration or deceleration of the trolley as a function of variables such as the length of a rope holding the suspended load up, a reference swinging period of the suspended load, a trolley reference swinging period, a hoist speed and the time from the initiation of the trolley acceleration or deceleration of the trolley, and drives the trolley according to the obtained speed patterns. Thus, the method carries out the swing stopping control so that the deviation angle of the suspended load from the vertical direction becomes zero at the time when the acceleration or deceleration of the trolley is ended.

Here, the reference swinging period of the suspended load is desirably obtained under the condition of making the deviation angle of the suspended load from the vertical direction zero on the assumption that the hoist is in motion at a constant speed from the initiation of acceleration or deceleration of the trolley to the end of acceleration or deceleration thereof.

Furthermore, in the method of swing stopping control of a suspended load according to embodiments of the invention, the optimum reference swinging period at the time of acceleration or deceleration of the trolley is desirably obtained with the use of data such as the trolley acceleration or deceleration time, the rope length at the initiation of the acceleration or deceleration of the trolley or at the end of the acceleration or deceleration of the trolley and the hoist speed.

Moreover, a system of swing stopping control of a suspended load according to embodiments of the invention is provided with a path operation unit, a hoist speed pattern operation unit, a trolley speed pattern operation unit and a deceleration initiation distance operation unit.

Here, the path operation unit carries out operation of a travel path of the trolley and a travel path of the hoist from the starting point position to the end point position of the suspended load and outputs data of a trolley target position and a hoist target position.

The hoist speed pattern operation unit carries out operation of a hoist speed instruction and a hoist position instruction on the basis of the data of the hoist target position and the hoist present position to output the hoist speed instruction and the hoist position instruction. The deceleration initiation distance operation unit carries out operation of a trolley deceleration initiation distance with the use of data such as the trolley deceleration, the rope lengths at the initiation and at the end of the deceleration of the trolley, the hoist speed, the reference swinging period of the suspended load, the trolley deceleration time, the time at the initiation of the trolley deceleration and the time at the end of the trolley deceleration.

Further, the trolley speed pattern operation unit carries out operation of a trolley speed instruction and a trolley position instruction on the basis of the data of the trolley target position, the trolley present position, the trolley acceleration and deceleration and the trolley deceleration initiation distance to output the trolley speed instruction and the trolley position instruction.

In addition, when the trolley is made to travel to the target position, the trolley speed pattern operation unit, while carrying out the swing stopping control of a suspended load, is to carry out an operation on such a speed pattern that the trolley initiates deceleration when a positional deviation of the travel of the trolley from the target position thereof becomes equal to the deceleration initiation distance.

According to embodiments of the invention, even in the case in which the length of a rope holding a suspended load up is changed, by carrying out operations of the acceleration and deceleration of a trolley with relatively simple operation expressions and by driving the trolley according to a speed pattern based on the acceleration and deceleration, highly accurate swing stopping control can be carried out with a deviation angle of the rope of the suspended load from the vertical direction made reduced.

Moreover, by initiating the deceleration of the trolley at the time when the positional deviation of the travel of the trolley from the target position of the trolley becomes equal to the deceleration initiation distance obtained from the operation, positioning accuracies are also improved.

BRIEF DESCRIPTION OF THE DRAWINGS

These and/or other aspects and advantages will become apparent and more readily appreciated from the following description of the embodiments, taken in conjunction with the accompanying drawings of which.

DESCRIPTION OF EMBODIMENTS

In the following, an embodiment of the invention will be explained with reference to attached drawings.

Figure 1:
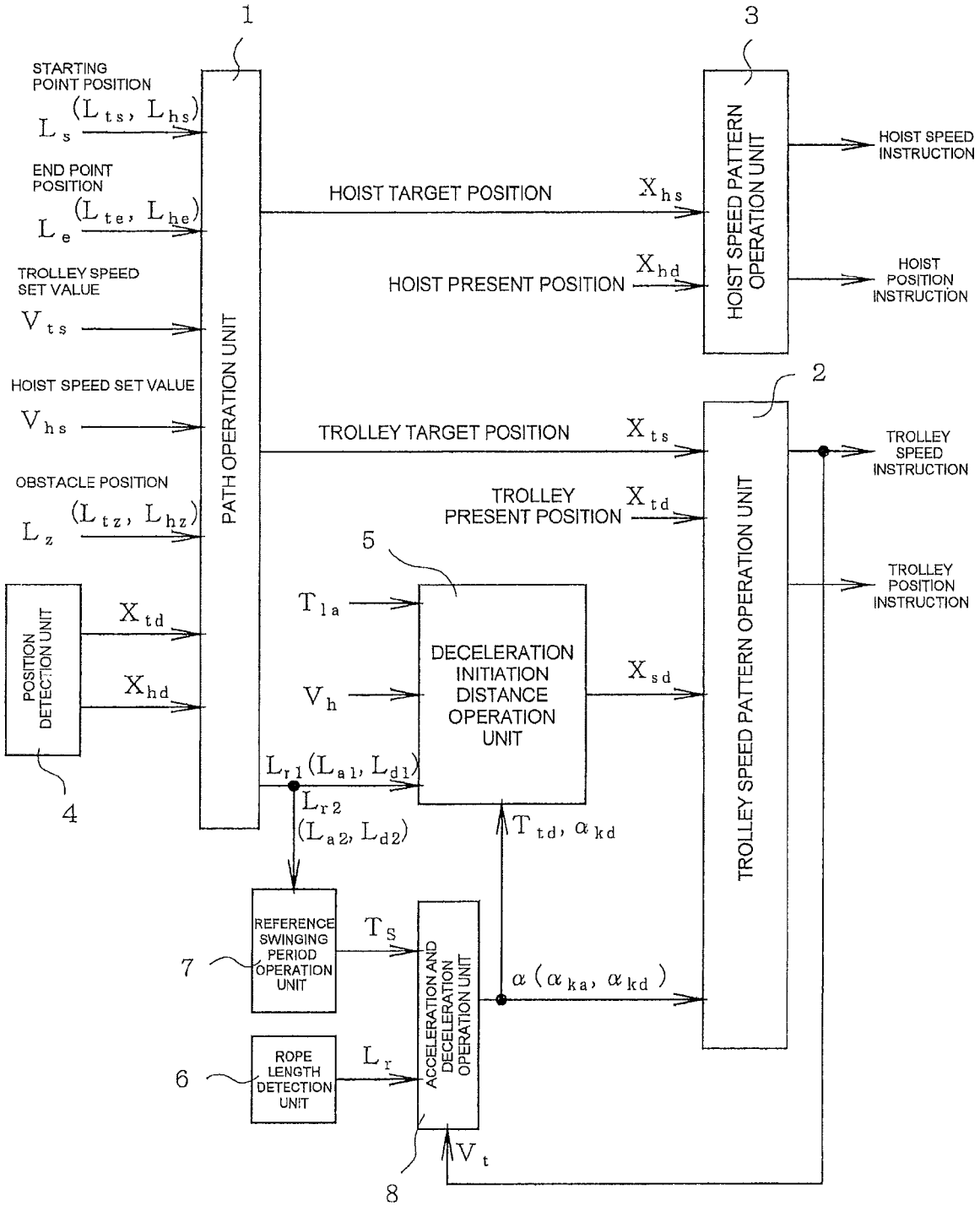
FIG. 1 is a block diagram of a driving control system of a crane including the swing stopping control system of a suspended load according to an embodiment of the invention.

First, FIG. 1 is a block diagram of a driving control system of a crane including the swing stopping control system according to the embodiment. The driving control system is to be actualized by a CPU and an execution program thereof, for example.

In FIG. 1, a path operation unit 1, on the basis of data of information of a crane starting position $L_s$ as a starting position of a suspended load, a crane end point position $L_e$ as an end point position of the suspended load, a trolley speed set value $V_{ts}$, a hoist speed set value $V_{hs}$, an obstacle position $L_z$, a trolley present position $X_{td}$ and a hoist present position $X_{hd}$, carries out operations on an optimum travel path of a suspended load for carrying the suspended load from a starting point position to an end point position while avoiding obstacles on a travel course and outputs the results of the operations as data of information of a trolley target position $X_{ts}$ and a hoist target position $X_{hs}$.

A position detection unit 4 detects a trolley present position $X_{td}$ and a hoist present position $X_{hd}$ by using an appropriate sensor and outputs the data of information of the detected positions $X_{td}$ and $X_{hd}$ to the path operation unit 1.

As data of information inputted to the path operation unit 1, the datum of the crane starting position $L_s$ includes data of a trolley starting position $L_{ts}$ and a hoist starting position $L_{hs}$, and the datum of the crane end point position $L_e$ includes data of a trolley end position $L_{te}$ and a hoist end position $L_{he}$.

Furthermore, the datum of the obstacle position $L_z$ includes data of a horizontal position $L_{tz}$ along the traveling direction of the trolley and a vertical position $L_{hz}$ along the traveling direction of the hoist.

In addition, from the path operation unit 1, data of a rope length $L_{r1}$ at the initiation of acceleration or deceleration and a rope length $L_{r2}$ at the end of acceleration or deceleration are also outputted.

The rope length $L_{r1}$ at the initiation of acceleration or deceleration is the rope length when initiating acceleration or deceleration of the trolley and includes a rope length $L_{a1}$ at the initiation of acceleration and a rope length $L_{d1}$ at the initiation of deceleration. Moreover, the rope length $L_{r2}$ at the end of acceleration or deceleration is the rope length when ending acceleration or deceleration of the trolley and includes a rope length $L_{a2}$ at the end of acceleration and a rope length $L_{d2}$ at the end of deceleration.

Figure 2:
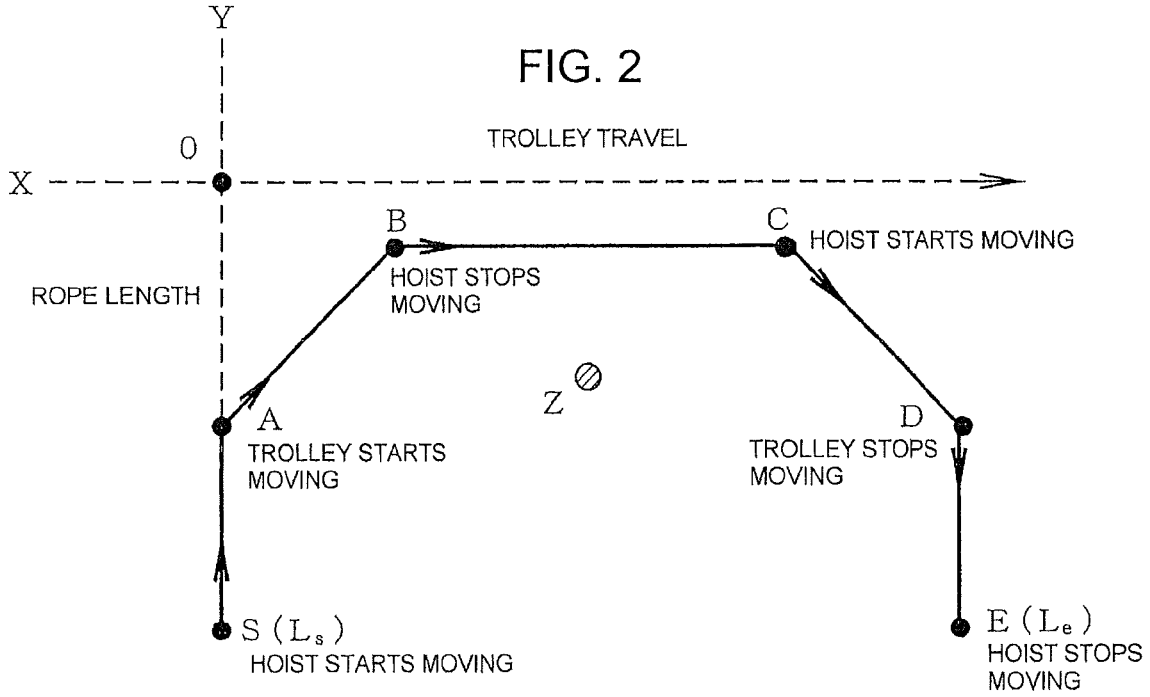
FIG. 2 is a diagram showing an example of a travel path established by operation carried out with the path operation unit in FIG. 1.

FIG. 2 shows an example of a travel path established by operation carried out with the path operation unit 1. The trolley is to travel linearly along the X axis in FIG. 2 and the hoist is to lift and lower a suspended load along the Y axis.

By using the data of the inputted information, the path operation unit 1 in FIG. 1 carries out operation of a travel path from a starting point S (crane starting point position $L_s$) to an end point E (crane end point position $L_e$) via points A, B, C and D in order as shown in FIG. 2. On the basis of the results of the operations, the trolley and hoist are made to travel while making reference to each other's positions and each time the trolley and hoist reach each point, a trolley target position $X_{ts}$ and hoist target position $X_{hs}$ are changed to the positions at the next point. In FIG. 2, the sign Z shows the position of an obstacle.

Here, the starting point S corresponds to the position at which the hoist is made to start moving for lifting a suspended load. Moreover, the points A and B correspond to the position at which the trolley is made to start moving and the position at which the hoist is made to stop moving, respectively. Furthermore, the points C and D correspond to the position at which the hoist is made to start moving for lowering the suspended load and the position at which the trolley is made to stop moving, respectively. In addition, the end point E corresponds to the position at which the hoist is made stopped.

Figure 3:
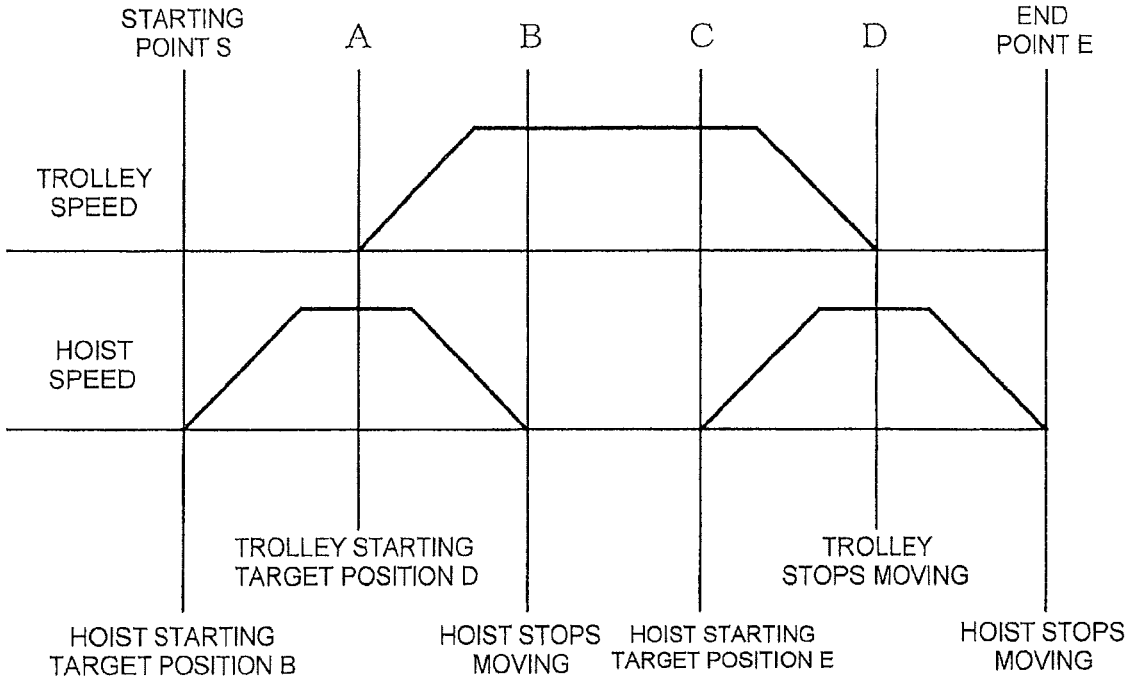
FIG. 3 is a diagram showing relations among an elapsed time, a trolley speed and a hoist speed together with the timings at the starting and stopping of the trolley and the hoist and the timing at each of target positions with respect to the travel path established as shown in FIG. 2.

In addition, FIG. 3 is a diagram showing relations among an elapsed time, a trolley speed and a hoist speed together with the timings at the starting and stopping of the trolley and the hoist and the timing at each of target positions with respect to the travel path established as shown in FIG. 2.

Figure 4:
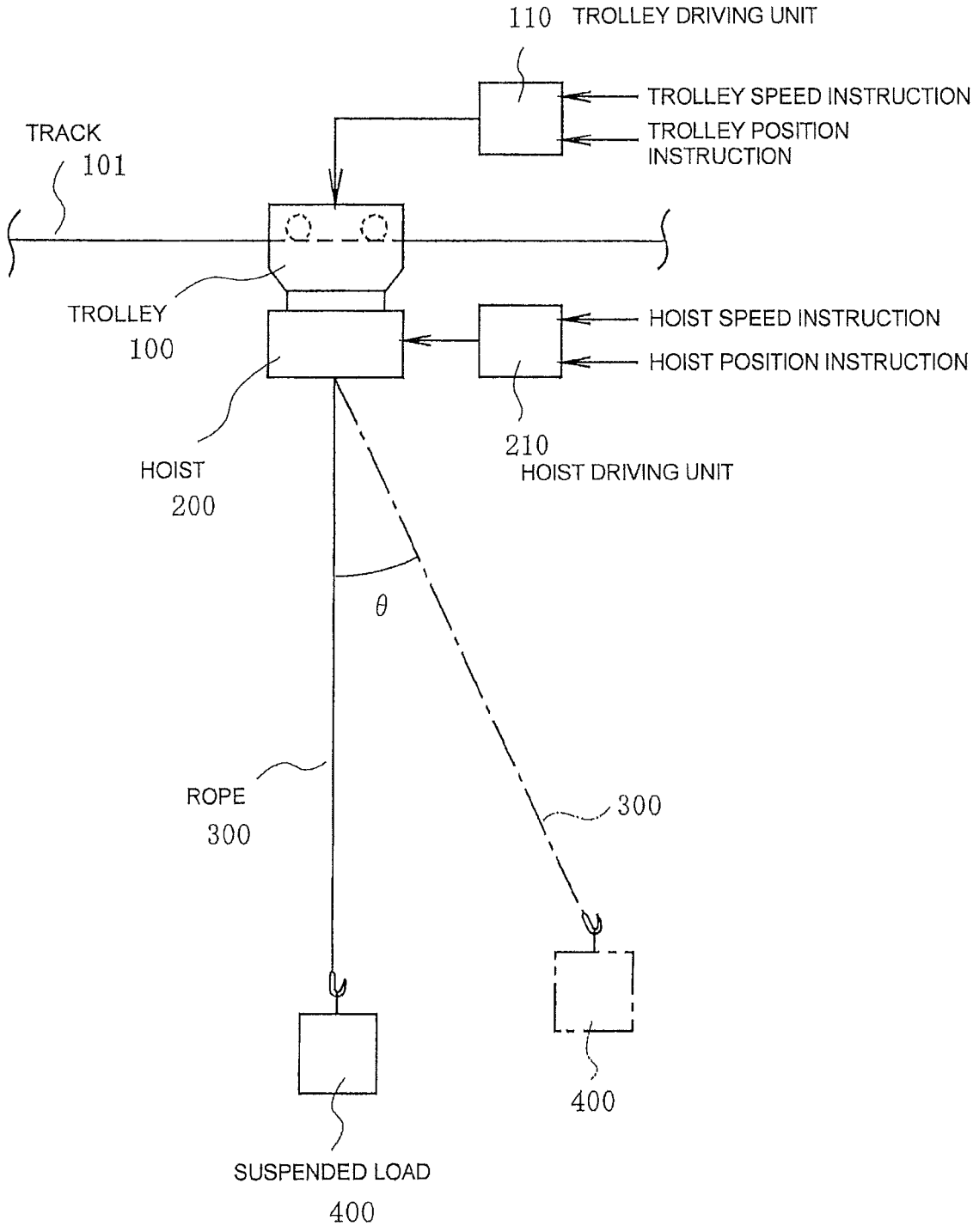
FIG. 4 is a diagram schematically showing the principal part of the crane.

Next, FIG. 4 is a diagram schematically showing the principal part of the crane. The crane includes a trolley 100, a track 101 on which the trolley 100 linearly travels, a trolley driving unit 110, a hoist 200, a hoist driving unit 210, and a rope 300 holding a suspended load 400 up. Here, θ denotes a deviation angle of the suspended load 400 (the rope 300) from the vertical direction.

Again in FIG. 1, a trolley speed pattern operation unit 2 carries out operation of a trolley speed instruction by using data of the trolley target position $X_{ts}$ outputted from the path operation unit 1, a trolley present position $X_{td}$, a trolley acceleration or deceleration a outputted from an acceleration and deceleration operation unit 8 and a trolley deceleration initiation distance $X_{sd}$ outputted from a deceleration initiation distance operation unit 5. The trolley speed pattern operation unit 2 carries out operation of a trolley position instruction by integrating thus obtained trolley speed instruction with respect to time and then outputs the trolley speed instruction and trolley position instruction to the trolley driving unit 110 as a trolley speed pattern.

The function of the deceleration initiation distance operation unit 5 will be explained later.

A hoist speed pattern operation unit 3 carries out operation of a hoist speed instruction by using data of the hoist target position $X_{hs}$ outputted from the path operation unit 1 and a hoist present position $X_{hd}$. The hoist speed pattern operation unit 3 carries out operation of a hoist position instruction by integrating thus obtained hoist speed instruction with respect to time and then outputs the hoist speed instruction and hoist position instruction to the hoist driving unit 210 as a hoist speed pattern.

The trolley driving unit 110 drives the trolley 100 by following the trolley speed instruction and trolley position instruction, and the hoist driving unit 210 drives the hoist 200 by following the hoist speed instruction and hoist position instruction, by which the trolley 100 and hoist 200 are to be driven by following the travel path shown in FIG. 2.

A reference swinging period operation unit 7 carries out operation on the reference swinging period Ts of a suspended load on the basis of the following equation of motion (equation of motion of a simple pendulum) (1) with respect to the deviation angle θ of the suspended load from the vertical direction under the condition of making the deviation angle θ zero on the assumption that the hoist is in motion at a constant speed from the time at the initiation of acceleration or deceleration of the trolley to the time at the end of acceleration or deceleration thereof:

$$L_r \cdot \frac{d^2\theta}{dt^2} + 2 \cdot \frac{dL_r}{dt} \cdot \frac{d\theta}{dt} + g\theta = -\alpha \tag{1}$$

where $L_r$ is the lope length, θ is the deviation angle of the suspended load (rope) from the vertical direction, g is the gravitational acceleration and α is the acceleration or deceleration of the trolley.

A rope length detection unit 6 in FIG. 1 detects the actual rope length $L_r$ changing with the traveling hoist with the use of an appropriate sensor and outputs the data of the detected rope length $L_r$.

The acceleration and deceleration operation unit 8 carries out operation with respect to the acceleration or deceleration a (acceleration $\alpha_{ka}$, deceleration $\alpha_{kd}$) given by the following equation (2) obtained by solving the equation (1) for the acceleration or deceleration α, and transmits the data of the acceleration or deceleration α obtained by the operation to the trolley speed pattern operation unit 2 for producing a trolley speed instruction:

$$\alpha(t) = \left[\frac{L_r}{g}(2\pi/Ts)2 - 1\right]\alpha k \cdot \cos\left(\frac{2\pi}{T_s}\right)t + \alpha k + \frac{\alpha_k}{g} \cdot 2Vh \cdot \left(\frac{2\pi}{T_s}\right) \cdot \sin\left(\frac{2\pi}{T_s}\right)t \tag{2}$$

where α(t) is the acceleration or deceleration of the trolley, $L_r$ is the rope length, g is the gravitational acceleration, $T_s$ is the reference swinging period of the suspended load, $\alpha_k$ is the reference acceleration or deceleration of the trolley, $V_h$ is the speed of the hoist and t is the time elapsed from the initiation of acceleration or deceleration.

Here, in the reference swinging period operation unit 7, the reference swinging period $T_{as}$ at the time of the trolley acceleration and the reference swinging period $T_{ds}$ at the time of the trolley deceleration may be obtained by the following method. In this case, it is necessary for the acceleration and deceleration operation unit 8 only to obtain the acceleration $\alpha_{ka}$ and the deceleration $\alpha_{kd}$ by using the data of the reference swinging periods $T_{as}$ and $T_{ds}$.

Namely, the reference swinging period operation unit 7 obtains the rope length $L_{a2}$ at the end of the trolley acceleration expressed by the expression (3) with the use of data of the hoist speed $V_h$, the trolley acceleration time $T_{ta}$ and the rope length $L_{a1}$ at the initiation of the trolley acceleration, and further, obtains the optimum reference swinging period $T_{as}$ at the time of the trolley acceleration by the expression (4):

$$L_{a2} = L_{a1} + V_h \cdot T_{ta} \tag{3}$$

$$T_{as} = T_{ta} = \frac{V_h(n\pi)^2/g + \sqrt{(V_h(n\pi)^2/g)^2 + 4L_{a1}(n\pi)^2/g}}{2}. \tag{4}$$

Moreover, at the trolley deceleration, the reference swinging period operation unit 7 obtains the rope length $L_{d2}$ at the end of the trolley deceleration by the operation similar to that carried out on the expression (3) with the use of data of the trolley acceleration time $T_{td}$ and the rope length $L_{d1}$ at the initiation of the trolley deceleration, and further, obtains the optimum reference swinging period $T_{ds}$ at the time of the trolley deceleration by the operation of the expression (5):

$$Tds = Ttd = \frac{V_h(n\pi)^2/g + \sqrt{(V_h(n\pi)^2/g)^2 + 4L_{d2}(n\pi)^2/g}}{2}. \tag{5}$$

In the expressions (4) and (5), n is an integer.

Further, the deceleration initiation distance operation unit 5 is a unit carrying out operations of a deceleration initiation distance of the trolley for positioning the trolley at a target position with a high accuracy. In addition, the trolley speed pattern operation unit 2 carries out an operation on such a speed pattern that the trolley initiates deceleration when a positional deviation of the travel of the trolley from the target position thereof becomes equal to the deceleration initiation distance and outputs the obtained speed pattern as trolley speed instructions.

Namely, the deceleration initiation distance operation unit 5 carries out operation on a deceleration initiation distance $X_{sd}$ by the expression (6) with the use of data of the trolley deceleration $\alpha_{kd}$, the rope length $L_{d1}$ at the initiation of deceleration of the trolley, the rope length $L_{d2}$ at the end of deceleration of the trolley, the hoist speed $V_h$, the reference swinging period $T_s$ of the suspended load, the trolley deceleration time $T_{td}$, the time $t_1$ at the initiation of trolley deceleration, the time $t_2$ at the end of trolley deceleration, the trolley deceleration period $\omega_0$ and the time t from the initiation of the deceleration of the trolley. In addition, to the deceleration initiation distance operation unit 5, the data of the rope length acceleration or deceleration time $T_{1a}$ is also inputted:

$$X_{sd} = \frac{\alpha_{kd}}{g}(L_{d1} - L_{d2}) - \frac{\alpha_{kd}}{2}\left\{\int_{t_1}^{t_2} V_h \cdot \cos\left(\frac{2\pi}{T_s}\right)\omega_0 t\, dt - 2\int_{t_1}^{t_2} V_h\, dt\right\} + \frac{\alpha_{kd}}{2} \cdot T_{td}^2. \tag{6}$$

Figure 5:
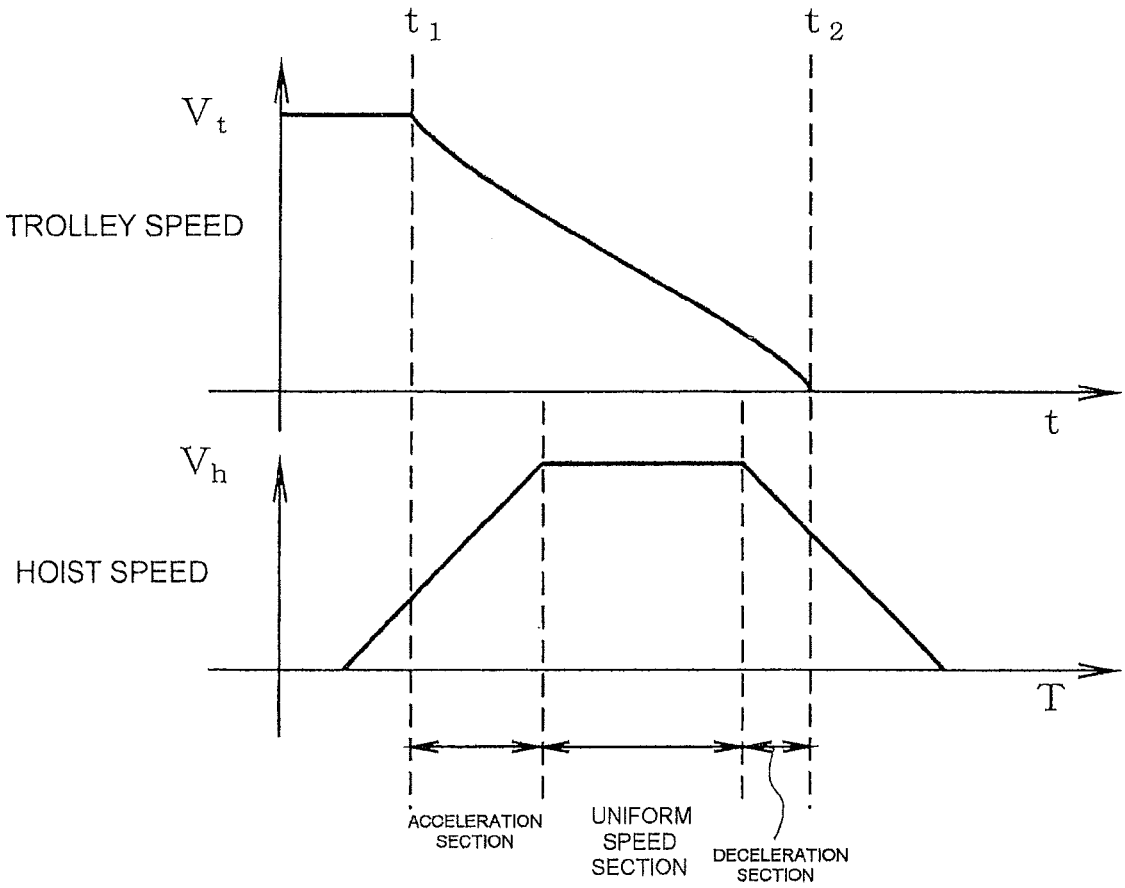
FIG. 5 is a diagram showing an example of a combination of patterns of a trolley speed and hoist speed assumed for the operation of a trolley deceleration initiation distance.

Incidentally, the trolley deceleration initiation distance $X_{sd}$ given by the expression (6) is a distance derived with a combination of the patterns of the trolley speed and hoist speed assumed which combination is such one as is shown with the combination in FIG. 5 taken as an example. Here, the hoist speed pattern becomes such a trapezoidal pattern that the acceleration section, the uniform speed section and the deceleration section of the hoist are included between the trolley deceleration initiation time $t_1$ and the trolley deceleration ending time $t_2$.

Figure 6:
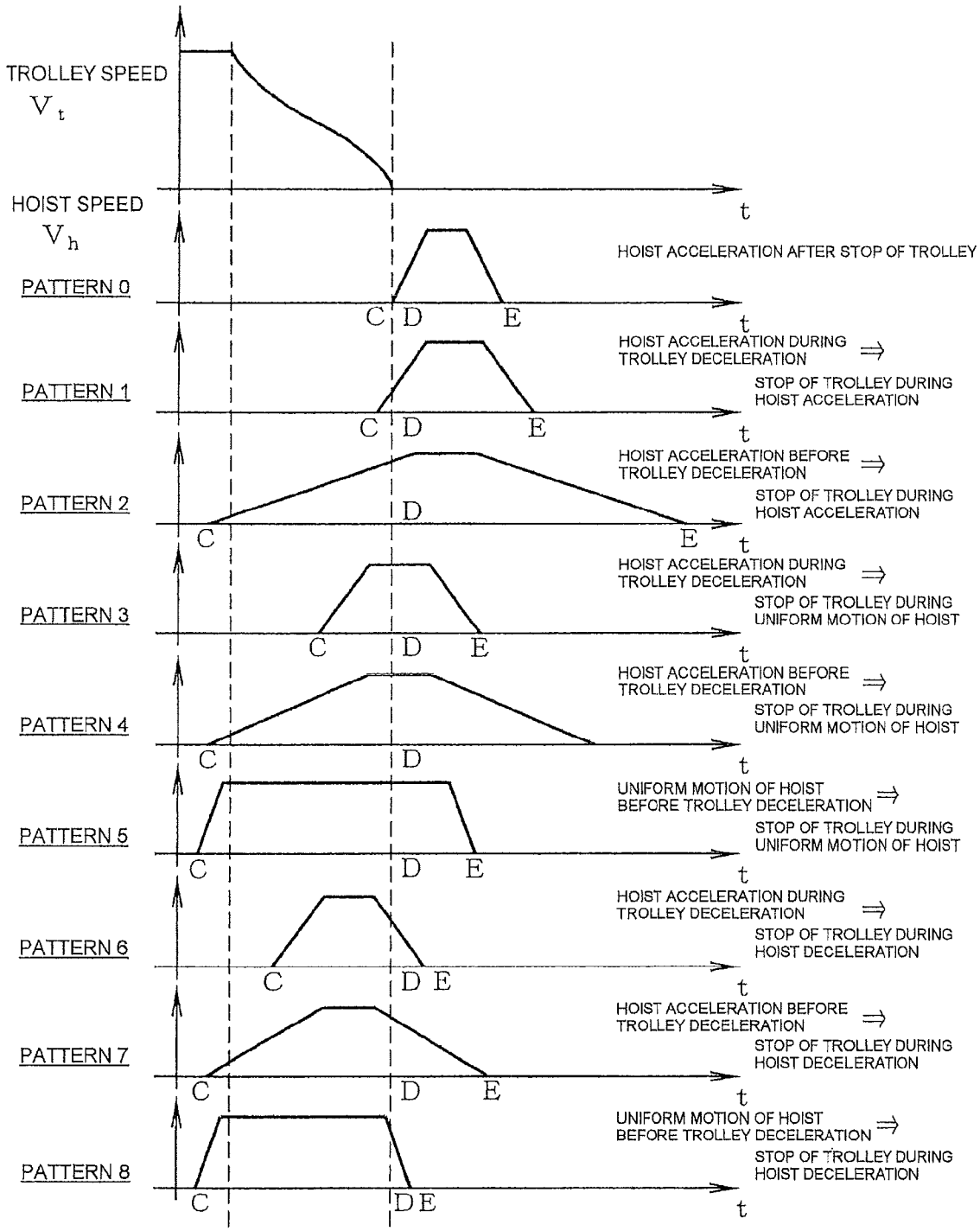
FIG. 6 is a diagram showing classified combinations of patterns of trolley speeds and hoist speeds for the operation of the most suited trolley deceleration initiation distance in an actual case.

Actually, however, the hoist speed $V_h$ is not to be uniformly determined. Therefore, combinations of the trolley speeds $V_t$ and hoist speeds $V_h$ are desirably classified into nine patterns as shown in FIG. 6 to have the operation of the expression (6) carried out on a pattern most suited for an actual case for obtaining the trolley deceleration initiation distance $X_{sd}$. The previously explained pattern shown in FIG. 5 corresponds to the pattern 7 in FIG. 6.

Figure 7:
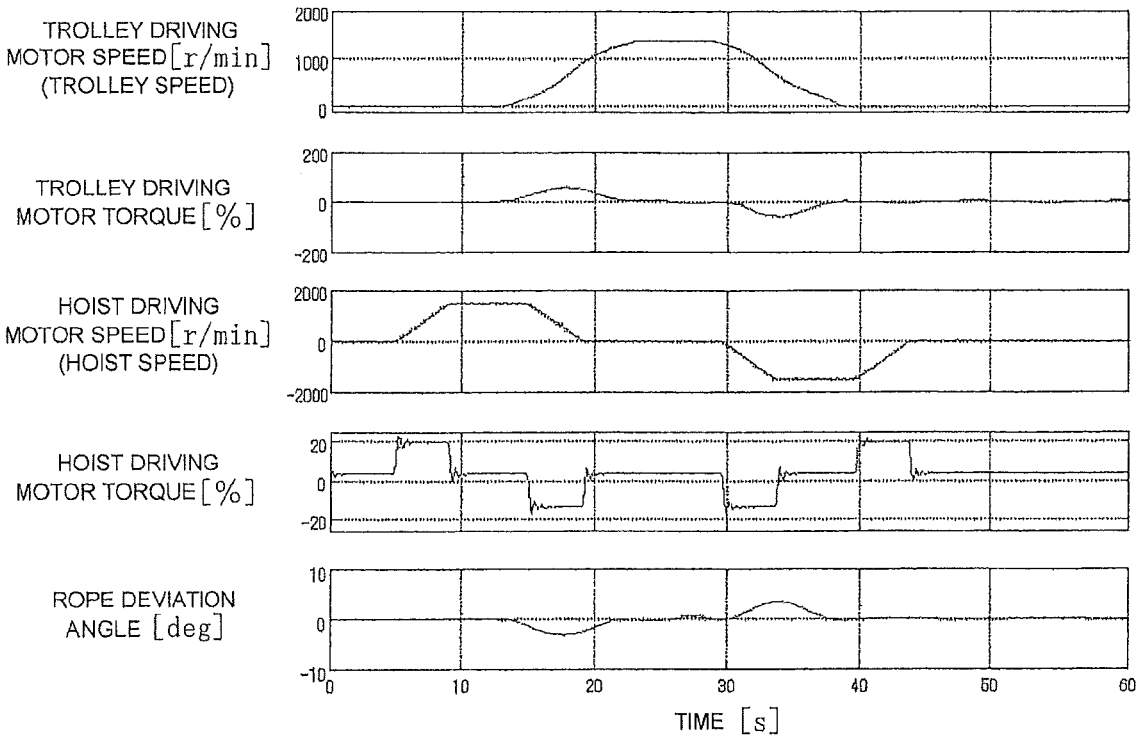
FIG. 7 is a waveform diagram showing an example of results of simulations on the trolley driving motor speed and torque, the hoist driving motor speed and torque and the rope deviation angle from the vertical direction in the swing stopping control according to embodiments of the invention.
Figure 8:
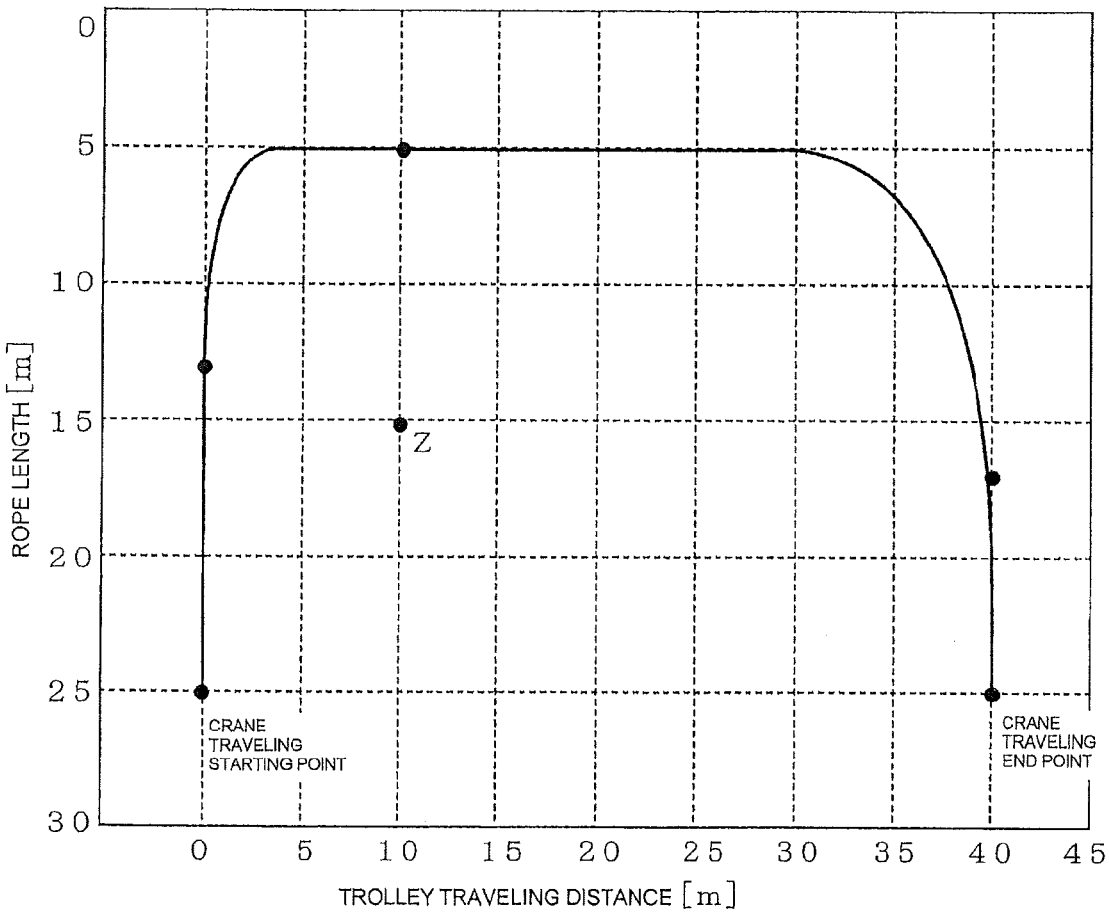
FIG. 8 is a diagram showing the travel path of the suspended load in the simulation with the example of the results thereof shown in FIG. 7.

Subsequent to this, FIG. 7 is a waveform diagram showing an example of results of simulations of the trolley driving motor speed (equivalent to the trolley speed), the trolley driving motor torque, the hoist driving motor speed (equivalent to the hoist speed), the hoist driving motor torque and the rope (suspended load) deviation angle from the vertical direction in the swing stopping control according to embodiments of the invention. FIG. 8 is a diagram showing the travel path of the suspended load in the simulations with the example of the results thereof shown in FIG. 7, which diagram corresponds to that in FIG. 2.

Here, the conditions of the simulations are as those given in Table 1.

TABLE 1

| Items | Values |
|---|---|
| Initial rope length | 30 m |
| Trolley mass | 1000 kg |
| Suspended load mass | 4000 kg |
| Trolley speed | 2.5 m/s |
| Hoist speed | 2.0 m/s |

As is apparent from FIG. 7 and FIG. 8, according to embodiments of the invention, the deviation angle of the suspended load (rope) from the vertical direction at the end of the acceleration or deceleration of the trolley becomes approximately zero, which proves that highly accurate swing stopping control is achieved.

While the present invention has been particularly shown and described with reference to the embodiments thereof, it will be understood by those skilled in the art that the foregoing and other changes in form and details can be made therein without departing from the spirit and scope of the present invention.

What is claimed is:

1. A method of swing stopping control of a suspended load of a crane having a hoist carrying out lifting and lowering of a load suspended by a rope and a trolley traveling on a track while holding the suspended load up, the method comprising:

solving an equation of motion, given below as equation (1) with respect to a deviation angle of the suspended load from a vertical direction when the trolley travels, for acceleration of the trolley to thereby obtain a value of one of the acceleration and deceleration of the trolley given below by equation (2);

obtaining speed patterns corresponding to values of the one of the acceleration and deceleration;

driving the trolley according to the speed patterns, such that the trolley initiates deceleration when a positional deviation of an actual position of the trolley from a target position of the trolley is equal to a deceleration initiation distance; and carrying out control so that the deviation angle of the suspended load from the vertical direction is equal to zero at a time when the one of the acceleration and deceleration is ended:

$$L_r \cdot \frac{d^2\theta}{dt^2} + 2 \cdot \frac{dL_r}{dt} \cdot \frac{d\theta}{dt} + g\theta = -\alpha \tag{1}$$

where $L_r$ is a rope length, θ is the deviation angle of the suspended load from the vertical direction, g is gravitational acceleration and α is the one of the acceleration and deceleration of the trolley, and $$\alpha(t) = \left[\frac{L_r}{g}(2\pi/T_s)^2 - 1\right]\alpha k \cdot \cos\left(\frac{2\pi}{T_s}\right)t + \alpha k + \frac{\alpha_k}{g} \cdot 2V_h \cdot \left(\frac{2\pi}{T_s}\right) \cdot \sin\left(\frac{2\pi}{T_s}\right)t \quad (2)$$

where α(t) is the one of the acceleration and deceleration of the trolley, $L_r$ is the rope length, g is the gravitational acceleration, $T_s$ is a reference swinging period of the suspended load, $\alpha_k$ is one of a reference acceleration and a reference deceleration of the trolley, $V_h$ is a hoist speed and t is a time elapsed from the initiation of one of the acceleration and deceleration.

2. The method of swing stopping control of a suspended load of a crane according to claim 1, wherein the reference swinging period of the suspended load is obtained under the condition of making the deviation angle θ in the expression (1) zero on the assumption that the hoist is in motion at a constant speed from the initiation of one of acceleration and deceleration of the trolley to the end of one of the acceleration and deceleration thereof.

3. The method of swing stopping control of a suspended load of a crane according to claim 2, wherein:

at the time of acceleration of the trolley, the rope length $L_{a2}$ at the end of the acceleration of the trolley is expressed by the expression (3) below with the trolley acceleration time, the rope length at the initiation of acceleration of the trolley and the hoist speed taken as $T_{ta}$, $L_{a1}$ and $V_h$, respectively, and along with this, the optimum reference swinging period $T_{as}$ is obtained by the expression (4) below;

at the time of deceleration of the trolley, the optimum reference swinging period $T_{ds}$ is obtained by the expression (5) below with the trolley deceleration time, the rope length at the initiation of deceleration of the trolley, the hoist speed and the rope length at the end of deceleration of the trolley taken as $T_{td}$, $L_{d1}$, $V_h$, and $L_{d2}$, respectively:

$$L_{a2} = L_{a1} + V_h \cdot T_{ta} \quad (3)$$

$$T_{as} = T_{ta} = \frac{V_h(n\pi)^2/g + \sqrt{(V_h(n\pi)^2/g)^2 + 4L_{a1}(n\pi)^2/g}}{2} \quad (4)$$

$$T_{ds} = T_{td} = \frac{V_h(n\pi)^2/g + \sqrt{(V_h(n\pi)^2/g)^2 + 4L_{d2}(n\pi)^2/g}}{2}, \quad (5)$$

in the expressions (4) and (5), n is an integer.

4. A system of swing stopping control of a suspended load of a crane having a hoist carrying out lifting and lowering of the suspended load by a rope and a trolley traveling on a track while holding up the suspended load, the system comprising:

a memory receiving at least position data of a starting point position of the trolley, a starting point position of the hoist, an end point position of the trolley, an end point position of the hoist, a trolley speed set value and a hoist speed set value;

at least one hardware processor carrying out operations of calculating a travel path of the trolley and a travel path of the hoist from the position data;

outputting target data of a trolley target position and a hoist target position;

generating a hoist speed instruction and a hoist position instruction of the hoist based on the target data of the hoist target position and a present hoist position by determining a reference swinging period Ts of the suspended load using equation of motion (1) below:

$$L_r \cdot \frac{d^2\theta}{dt^2} + 2 \cdot \frac{dL_r}{dt} \cdot \frac{d\theta}{dt} + g\theta = -\alpha \quad (1)$$

where $L_r$ is a rope length, θ is a deviation angle of the suspended load from the vertical direction, g is gravitational acceleration and α is one of acceleration and deceleration of the trolley; and determining one of acceleration and deceleration α of the trolley using equation (2) below by solving equation (1) above for the one of acceleration and deceleration α of the trolley and outputting the hoist speed instruction of the trolley:

$$\alpha(t) = \left[\frac{L_r}{g}(2\pi/T_s)^2 - 1\right]\alpha k \cdot \cos\left(\frac{2\pi}{T_s}\right)t + \alpha k + \frac{\alpha_k}{g} \cdot 2V_h \cdot \left(\frac{2\pi}{T_s}\right) \cdot \sin\left(\frac{2\pi}{T_s}\right)t \quad (2)$$

where α(t) is one of the acceleration and deceleration of the trolley, $L_r$ is the rope length, g is gravitational acceleration, $T_s$ is the reference swinging period of the suspended load, $\alpha_k$ is one of a reference acceleration and a reference deceleration of the trolley, $V_h$ is a speed of the hoist and t is a time elapsed from the initiation of one of the acceleration and deceleration of the trolley;

controlling operation for a deceleration initiation distance $X_{sd}$ of the trolley using equation (6) below:

$$X_{sd} = \frac{\alpha_{kd}}{g}(L_{d1} - L_{d2}) - \frac{\alpha_{kd}}{2}\left\{\int_{t_1}^{t_2} V_h \cdot \cos\left(\frac{2\pi}{T_s}\right)\omega_0 t\, dt - 2\int_{t_1}^{t_2} V_h\, dt\right\} + \frac{\alpha_{kd}}{2} \cdot T_{td}^2; \quad (6)$$

where $\alpha_{kd}$ is deceleration of the trolley, $L_{d1}$ is a rope length at initiation of deceleration of the trolley, $L_{d2}$ is a rope length at the end of deceleration of the trolley, $V_h$ is a speed of the hoist, $T_s$ is the reference swinging period of the suspended load, $T_{td}$ is a deceleration time of the trolley, $t_1$ is a time at the initiation of deceleration of the trolley, $t_2$ is a time at the end of deceleration of the trolley, $\omega_0$ is a deceleration period of the trolley and t is a time from the initiation of deceleration of the trolley;

generating a trolley speed instruction and a trolley position instruction of the trolley based on the target data of the trolley target position, a present trolley position, acceleration and deceleration of the trolley and the deceleration initiation distance; and controlling the trolley to travel to the target position along the travel path, using a speed pattern in which the trolley initiates deceleration when a positional deviation of an actual position of the trolley from the target position of the trolley is equal to the deceleration initiation distance.

5. A system of swing stopping control of a suspended load of a crane having a hoist carrying out lifting and lowering of the suspended load by a rope and a trolley traveling on a track while holding up the suspended load, the system comprising:

a memory receiving at least position data of a starting point position of the trolley, a starting point position of the hoist, an end point position of the trolley, an end point position of the hoist, a trolley speed set value and a hoist speed set value;

at least one hardware processor carrying out operations of calculating a travel path of the trolley and a travel path of the hoist from the position data;

outputting target data of a trolley target position and a hoist target position;

generating a hoist speed instruction and a hoist position instruction of the hoist based on target data of the hoist target position and a present hoist position;

determining a reference swinging period Ts of the suspended load using the equation of motion (1) below, such that a deviation angle θ is equal to zero on the assumption that the hoist is in motion at a constant speed from the initiation of one of acceleration and deceleration of the trolley to the end of one of acceleration and deceleration of the trolley:

$$L_r \cdot \frac{d^2\theta}{dt^2} + 2 \cdot \frac{dL_r}{dt} \cdot \frac{d\theta}{dt} + g\theta = -\alpha \tag{1}$$

where $L_r$ is a rope length, θ is the deviation angle of the suspended load from the vertical direction, g is gravitational acceleration and α is one of acceleration and deceleration of the trolley; and determining one of acceleration and deceleration α of the trolley using equation (2) below by solving equation (1) above for the one of acceleration and deceleration α of the trolley and outputting the hoist speed instruction of the trolley:

$$\alpha(t) = \left[\frac{L_r}{g}(2\pi/T_s)^2 - 1\right]\alpha k \cdot \cos\left(\frac{2\pi}{T_s}\right)t + \alpha k + \frac{\alpha_k}{g} \cdot 2V_h \cdot \left(\frac{2\pi}{T_s}\right) \cdot \sin\left(\frac{2\pi}{T_s}\right)t \tag{2}$$

where α(t) is one of the acceleration and deceleration of the trolley, $L_r$ is the rope length, g is gravitational acceleration, $T_s$ is the reference swinging period of the suspended load, $\alpha_k$ is one of a reference acceleration and a reference deceleration of the trolley, $V_h$ is a speed of the hoist and t is a time elapsed from the initiation of one of the acceleration and deceleration of the trolley;

controlling operation for a deceleration initiation distance $X_{sd}$ of the trolley using equation (6) below:

$$X_{sd} = \frac{\alpha_{kd}}{g}(L_{d1} - L_{d2}) - \frac{\alpha_{kd}}{2}\left\{\int_{t_1}^{t_2} V_h \cdot \cos\left(\frac{2\pi}{T_s}\right)\omega_0 t\, dt - 2\int_{t_1}^{t_2} V_h\, dt\right\} + \frac{\alpha_{kd}}{2} \cdot T_{td}^2; \tag{6}$$

where $\alpha_{kd}$ is deceleration of the trolley, $L_{d1}$ is a rope length at initiation of deceleration of the trolley, $L_{d2}$ is a rope length at the end of deceleration of the trolley, $V_h$ is a speed of the hoist, $T_s$ is the reference swinging period of the suspended load, $T_{td}$ is a deceleration time of the trolley, $t_1$ is a time at the initiation of deceleration of the trolley, $t_2$ is a time at the end of deceleration of the trolley, $\omega_0$ is a deceleration period of the trolley and t is a time from the initiation of deceleration of the trolley;

generating a trolley speed instruction and a trolley position instruction of the trolley based on the target data of the trolley target position, a present trolley position, acceleration and deceleration of the trolley and the deceleration initiation distance; and controlling the trolley to travel to the target position along the travel path, using a speed pattern in which the trolley initiates deceleration when a positional deviation of an actual position of the trolley from the target position of the trolley is equal to the deceleration initiation distance.

6. A system of swing stopping control of a suspended load of a crane having a hoist carrying out lifting and lowering of the suspended load by a rope and a trolley traveling on a track while holding up the suspended load, the system comprising:

a memory receiving at least position data of a starting point position of the trolley, a starting point position of the hoist, an end point position of the trolley, an end point position of the hoist, a trolley speed set value and a hoist speed set value;

at least one hardware processor carrying out operations of calculating a travel path of the trolley and a travel path of the hoist from the position data;

outputting target data of a trolley target position and a target position;

generating a hoist speed instruction and a hoist position instruction of the hoist based on target data of the hoist target position and a present hoist position by determining a reference swinging period Ts of the suspended load using the equation of motion (1) below, such that a deviation angle θ is equal to zero on the assumption that the hoist is in motion at a constant speed from the initiation of one of acceleration and deceleration of the trolley to the end of one of acceleration and deceleration of the trolley:

$$L_r \cdot \frac{d^2\theta}{dt^2} + 2 \cdot \frac{dL_r}{dt} \cdot \frac{d\theta}{dt} + g\theta = -\alpha \tag{1}$$

where $L_r$ is a rope length, θ is a deviation angle of the suspended load from the vertical direction, g is gravitational acceleration and α is one of acceleration and deceleration of the trolley; and determining one of acceleration and deceleration α of the trolley using equation (2) below by solving equation (1) above for the one of acceleration or deceleration α of the trolley and outputting the hoist speed instruction of the trolley:

$$\alpha(t) = \left[\frac{L_r}{g}(2\pi/T_s)^2 - 1\right]\alpha k \cdot \cos\left(\frac{2\pi}{T_s}\right)t + \alpha k + \frac{\alpha_k}{g} \cdot 2V_h \cdot \left(\frac{2\pi}{T_s}\right) \cdot \sin\left(\frac{2\pi}{T_s}\right)t \tag{2}$$

where α(t) is one of the acceleration and deceleration of the trolley, $L_r$ is the rope length, g is gravitational acceleration, $T_s$ is the reference swinging period of the suspended load, $\alpha_k$ is one of a reference acceleration and a reference deceleration of the trolley, $V_h$ is a speed of the hoist and t is a time elapsed from the initiation of one of the acceleration and deceleration of the trolley, when at the time of acceleration of the trolley, a rope length $L_{a2}$ at the end of the acceleration of the trolley is given by equation (3):

$$L_{a2} = L_{a1} + V_h \cdot T_{ta} \tag{3}$$

where $T_{ta}$ is the acceleration time of the trolley, $L_{a1}$ is a rope length at the initiation of acceleration of the trolley, $V_h$ is the speed of the hoist, and n is an integer and an optimum reference swinging period $T_{as}$ is given by equation (4);

$$T_{as} = T_{ta} = \frac{V_h(n\pi)^2/g + \sqrt{(V_h(n\pi)^2/g)^2 + 4L_{a1}(n\pi)^2/g}}{2} \tag{4}$$

and at the time of deceleration of the trolley, an optimum reference swinging period $T_{ds}$ is given by equation (5):

$$T_{ds} = T_{td} = \frac{V_h(n\pi)^2/g + \sqrt{(V_h(n\pi)^2/g)^2 + 4L_{d2}(n\pi)^2/g}}{2}, \tag{5}$$

where $T_{td}$ is the trolley deceleration time, $L_{d1}$ is a rope length at the initiation of deceleration of the trolley, $V_h$ is the hoist speed, $L_{d2}$ is a rope length at the end of deceleration of the trolley and n is an integer;

controlling operation for a deceleration initiation distance $X_{sd}$ of the trolley using equation (6) below:

$$X_{sd} = \frac{\alpha_{kd}}{g}(L_{d1} - L_{d2}) - \frac{\alpha_{kd}}{2}\left\{\int_{t_1}^{t_2} V_h \cdot \cos\left(\frac{2\pi}{T_s}\right)\omega_0 t\,dt - 2\int_{t_1}^{t_2} V_h\,dt\right\} + \frac{\alpha_{kd}}{2} \cdot T_{td}^2; \tag{6}$$

where $\alpha_{kd}$ is deceleration of the trolley, $L_{d1}$ is the rope length at initiation of deceleration of the trolley, $L_{d2}$ is the rope length at the end of deceleration of the trolley, $V_h$ is the speed of the hoist, $T_s$ is the reference swinging period of the suspended load, $T_{td}$ is the deceleration time of the trolley, $t_1$ is a time at the initiation of deceleration of the trolley, $t_2$ is a time at the end of deceleration of the trolley, $\omega_0$ is a deceleration period of the trolley and t is a time from the initiation of deceleration of the trolley;

generating a trolley speed instruction and a trolley position instruction of the trolley based on the target data of the trolley target position, a present trolley position, acceleration and deceleration of the trolley and the deceleration initiation distance; and controlling the trolley to travel to the target position along the travel path, using a speed pattern in which the trolley initiates deceleration when a positional deviation of an actual position of the trolley from the target position of the trolley is equal to the deceleration initiation distance.

* * * * *

UNITED STATES PATENT AND TRADEMARK OFFICE

CERTIFICATE OF CORRECTION

PATENT NO. : 8,955,701 B2
APPLICATION NO. : 13/416393
DATED : February 17, 2015
INVENTOR(S) : Hideto Ueda et al.

It is certified that error appears in the above-identified patent and that said Letters Patent is hereby corrected as shown below:

In the claims

Claim 1, Column 9, Lines 6-8:

Delete " $\alpha(t) = \left[\frac{L_r}{g}(2\pi/T_s)^2 - 1\right]\alpha k \cdot \cos\left(\frac{2\pi}{T_s}\right)t + \alpha k + \frac{\alpha_k}{g} \cdot 2V_h \cdot \left(\frac{2\pi}{T_s}\right) \cdot \sin\left(\frac{2\pi}{T_s}\right)t$ " and insert -- $\alpha(t) = [\frac{L_r}{g}(2\pi/T_s)^2 - 1]\alpha_k \cdot \cos(\frac{2\pi}{T_s})t + \alpha_k + \frac{\alpha_k}{g} \cdot 2V_h \cdot (\frac{2\pi}{T_s}) \cdot \sin(\frac{2\pi}{T_s})t$ --, therefor.

Claim 4, Column 10, Lines 26-27:

Delete " $\alpha(t) = \left[\frac{L_r}{g}(2\pi/T_s)^2 - 1\right]\alpha k \cdot \cos\left(\frac{2\pi}{T_s}\right)t + \alpha k + \frac{\alpha_k}{g} \cdot 2V_h \cdot \left(\frac{2\pi}{T_s}\right) \cdot \sin\left(\frac{2\pi}{T_s}\right)t$ " and insert -- $\alpha(t) = [\frac{L_r}{g}(2\pi/T_s)^2 - 1]\alpha_k \cdot \cos(\frac{2\pi}{T_s})t + \alpha_k + \frac{\alpha_k}{g} \cdot 2V_h \cdot (\frac{2\pi}{T_s}) \cdot \sin(\frac{2\pi}{T_s})t$ --, therefor.

Claim 5, Column 11, Lines 37-39:

Delete " $\alpha(t) = \left[\frac{L_r}{g}(2\pi/T_s)^2 - 1\right]\alpha k \cdot \cos\left(\frac{2\pi}{T_s}\right)t + \alpha k + \frac{\alpha_k}{g} \cdot 2V_h \cdot \left(\frac{2\pi}{T_s}\right) \cdot \sin\left(\frac{2\pi}{T_s}\right)t$ " and insert -- $\alpha(t) = [\frac{L_r}{g}(2\pi/T_s)^2 - 1]\alpha_k \cdot \cos(\frac{2\pi}{T_s})t + \alpha_k + \frac{\alpha_k}{g} \cdot 2V_h \cdot (\frac{2\pi}{T_s}) \cdot \sin(\frac{2\pi}{T_s})t$ --, therefor.

Claim 6, Column 12, Line 30: Delete "Ts" and insert --$T_s$--, therefor.

Claim 6, Column 12, Line 52-54:

Delete " $\alpha(t) = \left[\frac{L_r}{g}(2\pi/T_s)^2 - 1\right]\alpha k \cdot \cos\left(\frac{2\pi}{T_s}\right)t + \alpha k + \frac{\alpha_k}{g} \cdot 2V_h \cdot \left(\frac{2\pi}{T_s}\right) \cdot \sin\left(\frac{2\pi}{T_s}\right)t$ " and insert -- $\alpha(t) = [\frac{L_r}{g}(2\pi/T_s)^2 - 1]\alpha_k \cdot \cos(\frac{2\pi}{T_s})t + \alpha_k + \frac{\alpha_k}{g} \cdot 2V_h \cdot (\frac{2\pi}{T_s}) \cdot \sin(\frac{2\pi}{T_s})t$ --, therefor.

Signed and Sealed this
Twentieth Day of October, 2015

Michelle K. Lee

Michelle K. Lee
*Director of the United States Patent and Trademark Office*